United States Patent [19]

Kimura et al.

[11] 4,036,600

[45] July 19, 1977

[54] STEEL SUBSTRATE ELECTROPLATED WITH Al POWDER DISPERSED IN Zn

[75] Inventors: Hajime Kimura; Takahisa Yoshihara; Shunichi Harada, all of Chiba, Japan

[73] Assignee: Kawasaki Steel Corporation, Kobe, Japan

[21] Appl. No.: 690,737

[22] Filed: May 27, 1976

[30] Foreign Application Priority Data

June 5, 1975 Japan ..... 50-67094

[51] Int. Cl.[2] ..... B32B 15/18; B32B 15/20; C25D 15/00

[52] U.S. Cl. ..... 428/555; 148/31.5; 204/16; 204/55 R; 204/55Y; 428/558; 428/653

[58] Field of Search ..... 29/191.4, 196.2, 196.5; 204/55 R, 55 Y, 16; 72/747; 148/31.5, 34, 127

[56] References Cited

U.S. PATENT DOCUMENTS

| | | | |
|---|---|---|---|
| 3,343,930 | 9/1967 | Borzillo et al. | 29/196.5 |
| 3,782,909 | 1/1974 | Cleary et al. | 29/196.2 |
| 3,791,801 | 2/1974 | Ariga et al. | 29/196.5 |
| 3,822,118 | 7/1974 | Fukuzuka et al. | 29/196.5 |
| 3,952,120 | 4/1976 | Horton et al. | 29/196.5 |

*Primary Examiner*—Arthur J. Steiner

[57] ABSTRACT

A composite zinc-aluminum dispersion plated steel sheet and a method of producing same are disclosed. The plated steel sheet comprises an electrolytical zinc plated layer containing 1.5 to 70% by weight of aluminum dispersed therein. The method comprises adding aluminum powder to an electrolytical zinc plating bath composition, dispersing the aluminum powder into the plating bath to provide a composite zinc-aluminum dispersion plating bath, and electrolytical treating a steel sheet in the composite zinc-aluminum dispersion plating bath while agitating it. The plated steel sheet enhances corrosion resistances and does not show any spangles which impair the appearances after subsequent painting of the plated steel sheet.

8 Claims, 4 Drawing Figures

FIG. 2 After Rolling
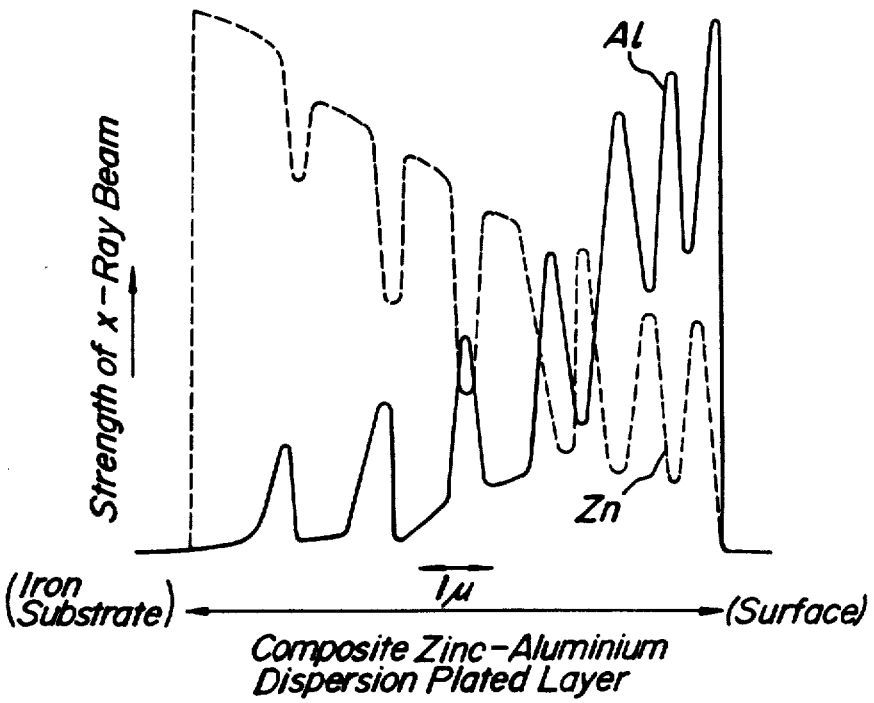

FIG_3 After Heat Treatment
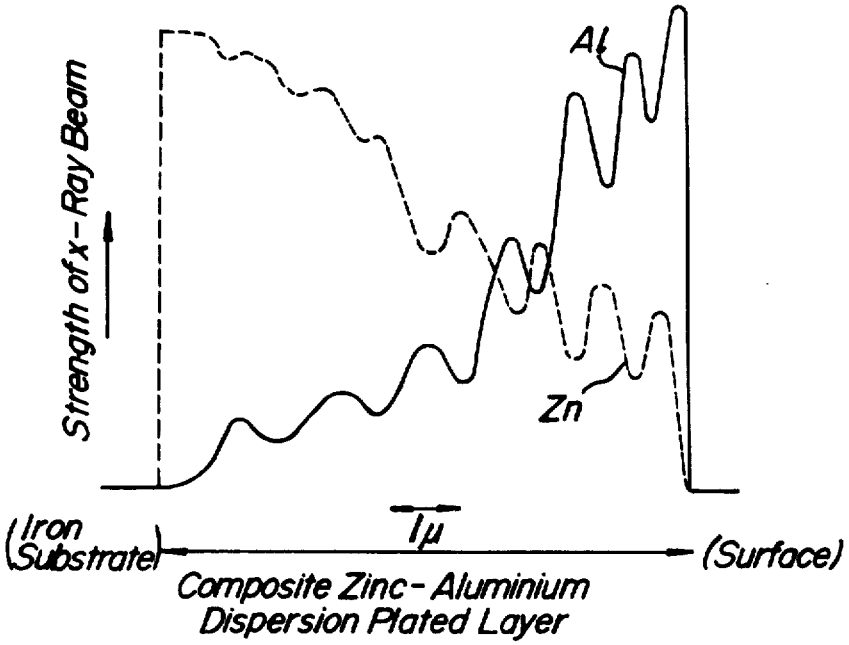
FIG_4
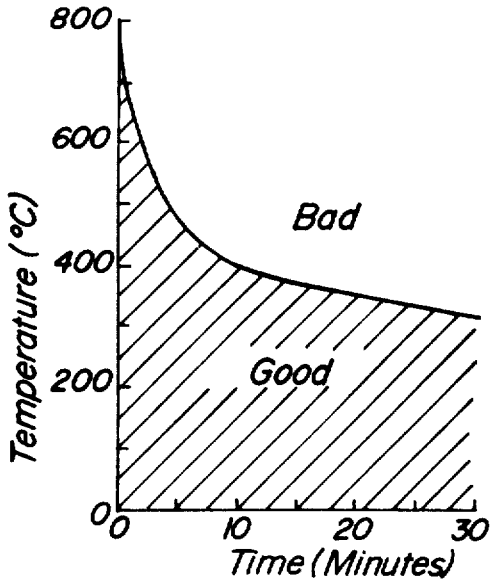

STEEL SUBSTRATE ELECTROPLATED WITH Al POWDER DISPERSED IN Zn

This invention relates to a composite zinc-aluminum dispersion plated steel sheet and a method of producing same.

An object of the invention is to provide a composite zinc-aluminum dispersion plated steel sheet which can remarkably improve corrosion resistance, and has a plated layer excellent in surface characteristics such as adhesion, deep drawing property and paint adhesion.

A molten zinc-aluminum alloy plated steel sheet which is comparable with the zinc-aluminum dispersion plated steel sheet according to the invention has recently been developed for the purpose of improving corrosion resistance of a conventional molten zinc plated steel sheet.

In such molten zinc-aluminum alloy plated steel sheet, the content of aluminum in the molten alloy bath is from 25 to 70% by weight and the molten alloy bath is required to be heated to a temperature of from 500° to 650° C. Such molten zinc-aluminum alloy plated steel sheet, therefore, has the disadvantage that heating cost becomes expensive, that the steel sheet is subjected to thermal hysteresis which causes to deteriorate the quality of the steel sheet, that a hard and brittle alloy layer formed of iron and of zinc-aluminum produced at an interphase between the iron substrate and the plated layer to deteriorate the adhesion of the plated layer and the deep drawing property of the plated steel sheet, that spangles inherent to the molten plating are produced to form indentations on the surface of the painted steel sheet thereby impairing the commercial value of the painted steel sheet, that the molten plating results in an increase of the amount of the coated layer which requires to increase a welding current or pressure in the case of spot welding the steel sheets, and that the welded chips become short in life.

The inventors have recognized that, after a great deal of experimental tests and investigations effected for the purpose of significantly improving corrosion resistance of electroplated zinc without impairing various characteristics inclusive of adhesion, deep drawing property and spot welding property, a composite zinc-aluminum dispersion plated steel sheet can be obtained by adding aluminum powder to an electrolytical zinc plating bath composition, dispersing the aluminum powder into the plating bath to provide a composite zinc-aluminum dispersion plating bath, and electrolytical treating a steel sheet in the composite zinc-aluminum dispersion plating bath while agitating it, and that in the composite zinc-aluminum dispersion plated steel sheet thus obtained aluminum containing zinc is deposited with a current efficiency of substantially at least 100% and the zinc plated layer contains at its surface side much amount of aluminum dispersed therein. The invention is intended to attain the above mentioned object based on the above mentioned recognition.

The composite plated layer according to the invention is particularly applicable to a steel sheet to be painted without producing spangles which have been encountered with the conventional molten zinc plated layer.

In the present invention, the electrolysis condition influencing upon the production of the composite zinc-aluminum dispersion plated layer is much influenced by main factors inclusive of the amount of aluminum powder to be added, the electrolytical zinc depositing plating bath composition, the moving speed of the steel sheet to be treated in the plating bath, and the plating bath temperature. As the electrolytical plating bath composition, use may be made of not only zinc sulfate plating bath which has most commonly been used in the conventional electrolytical zinc plating, but also an acid bath which contains chloride or zinc fluoborate or zinc sulfamate; or a neutral bath which contains zinc phosphate or zinc chloride ammine or low concentration zinc sulphate; or an alkaline bath which contains zinc cyanide or zincate or zinc triethanolamine.

As a result, the electrolytical zinc plating bath composition according to the invention shall be understood to include all of the above mentioned kinds of compositions. As aluminum powder to be added to the electrolytical zinc plating bath composition, use may be made of atomized aluminum powder per se available in market. It is preferable, however, to make the particle size of such atomized aluminum powder at least 100 meshes (at most 147 μm diameter), preferably at least 250 meshes (at most 61 μm diameter). Experimental tests have yielded the result that the amount of aluminum powder to be added should preferably be a range from 5 to 300 g/l. Addition of less than 5 g/l of aluminum powder results in an excessively small amount of aluminum dispersed in the zinc plated layer and hence in less contribution to improvement in corrosion resistance of the zinc plated layer, while addition of more than 300 g/l of aluminum powder causes an increase of viscosity of the electrolytical zinc plating bath thereby rendering it unpractical. It was found in this connection that the most preferable range of the amount of aluminum powder to be added in on the order of from 20 to 100 g/l.

The slower moving speed of a steel sheet or steel strip which forms a cathode in the plating bath results in an increase of aluminum content in the zinc plated layer and at the same time the electrolytic deposition on the surface of iron substrate becomes dendrite in shape. In order to avoid such disadvantage, it is necessary to intensely agitate the plating bath. Such intense agitation of the plating bath can efficiently be effected by supplying a jet stream into the plating bath or by increasing the moving speed of the steel sheet or steel strip.

The higher temperature of the plating bath also results in an increase of the amount of aluminum dispersed in the zinc plated layer. In practice, however, it is preferable to make the temperature of the plating bath a range from 20° to 80° C.

In the present invention, the content of aluminum dispersed in a composition plated layer can freely be controlled up to 70% by weight by taking the above mentioned fact into consideration and by treating a steel sheet under electrolysis condition applied to conventional zinc plating process. The presence of less than 1.5% by weight of aluminum in the plated layer is not sufficient to improve corrosion resistant property of the plated layer.

The surface of the plated layer obtained by the above mentioned electrolytic treatment is rough in appearance just like emery paper. If it is impossible to use such plated layer owing to its rough appearance, the rough surface may easily be made smooth by means of a leveller or press rolling so as to reduce its thickness by the order of 1 to 5%.

The inventors have found out that the smooth surface of the plated layer can improve corrosion resistant property thereof, that the press rolling for reducing thickness of the plated layer by the order of 2% is sufficient to improve the corrosion resistant property thereof, and that the higher press rolling results in considerably larger reduction in thickness of the plated layer and increase in hardness of the steel sheet.

The invention will now be described in greater detail with reference to the accompanying drawings, wherein:

FIG. 2 is a graph illustrating distribution of zinc and aluminum present in cross section of a composite plated layer immediately after rolling;

FIG. 3 is a graph illustrating distribution of zinc and aluminum present in cross section of a composite plated layer after heat treatment; and FIG. 4 is a graph illustrating a preferable range of temperature and time for heat treatment as is required for obtaining a good appearance of a plated sheet by a shaded area.

Figure 1:
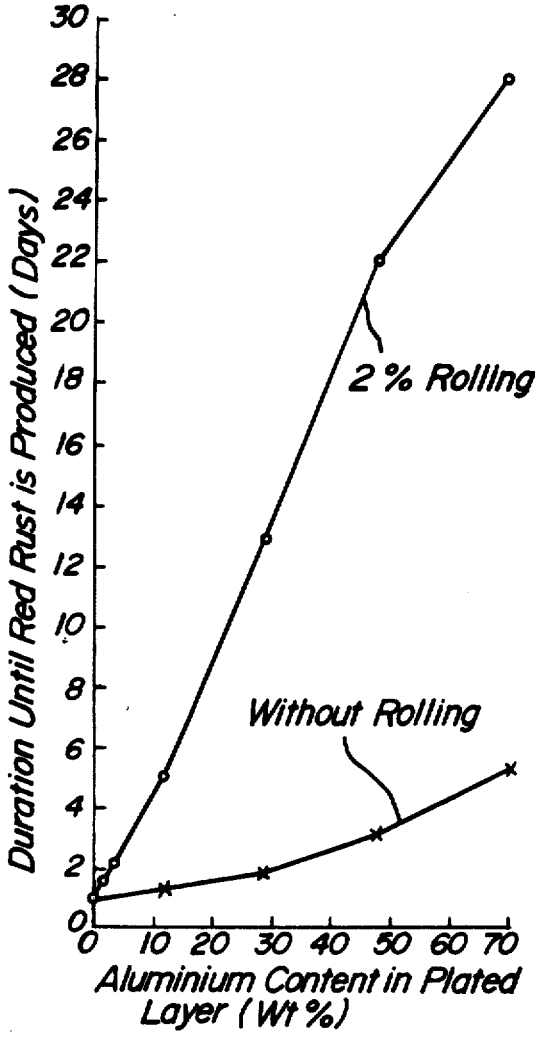
FIG. 1 is a graph illustrating a relation between aluminum content in a composite plated layer and duration until red rust is produced on the surface of the plated layer.

In FIG. 1 is shown a graph which illustrates a relation between aluminum content in a composite plated layer and duration until red rust is produced on the surface of the plated layer. In the present example, a composite zinc-aluminum dispersion coating was electrolytically plated onto the surface of a cold rolled steel sheet at 15 A/dm$^2$ for 1 minute. The above mentioned relations of the plated layer with or without subjected to rolling with 2% reduction in thickness are shown in FIG. 1.

Salt water spray test defined by JIS Z2371 has yielded the result that the corrosion resistant property of the plated layer is significantly improved substantially in proportion to an increase of aluminum content in the plated layer. In the case of aluminum content of, for example, 48% by weight, the duration until red rust is produced becomes 22 days which is 22 times longer than corresponding duration of 1 day (24 hours) of conventional electrolytical zinc plated layer. Even in the case of aluminum content of 1.5% by weight, the duration until red rust is produced becomes 36 hours which is about 1.5 times longer than the corresponding duration of 24 hours of the conventional zinc plated layer.

The reason why the presence of such small amount of aluminum dispersed in a zinc plated layer results in a significant improvement of corrosion resistant property of the zinc plated layer is not yet elucidated.

In FIG. 2 is shown a graph illustrating a cross section of a composite zinc-aluminum dispersion plated layer after rolling according to the invention obtained by line scanning analysis with the aid of an X-ray microanalyzer.

As seen from FIG. 2, the content of aluminum on the surface of the coated layer is larger than that in the iron substrate. It is conceivable that such distribution of aluminum effectively contributes to excellent corrosion resistant property of aluminum even when its content is smaller than that in the conventional molten zinc-aluminum plated steel sheet.

The zinc-aluminum dispersion plated layer having the distribution shown in FIG. 2 was obtained by dispersing 29% by weight of aluminum into the zinc plated layer under the following plating conditions and then subjecting the plated layer to a skin pass rolling with a reduction rate of thickness of 2%.

| | |
|---|---|
| Plating bath composition: | |
| ZnSO4 | 1 mol |
| $Na_2SO4$ | 0.2 mol |
| $Al_2(SO_4)3$ | 0.1 mol |
| Atomized aluminum powder (at least 325 meshes, at most 44 μm diameter) | 70 g/l |
| Plating condition: | |
| P.H. | 3.0 |
| Bath temperature | 60° C |
| Current density | 15 A/dm2 |
| Rotary speed of steel sheet | 500 r.p.m. |
| Plating time | 1 minute |
| Thickness of the plated layer | 8,6 μ |
| Amount of coated zinc | 30 g/m2 |
| Amount of coated aluminum | 12 g/m$^2$ |

In the composite plated layer formed on the surface of the steel sheet according to the invention, the presence of aluminum becomes rich in its distribution on the surface side of the plated layer than that on the inner side thereof, and as a result, it is conceivable that the slight rolling effected after the plating step can easily make aluminum on the surface layer compact thereby enhancing corrosion resistance.

In accordance with the invention, if necessary, a slight heat treatment is carried out after the slight rolling so as to further improve various characteristics of the composite plated steel sheet.

That is, the composite plated layer contains aluminum minutely dispersed therein, so that zinc makes contact with aluminum over an extremely wide area. As a result, if the composite plated layer is heat treated at a relatively low temperature for a relatively short time, zinc and aluminum are easily diffused with each other to form a zinc-aluminum alloy at the interphase between the two. The higher the temperature of heat treatment the sooner is the formation of the diffused alloy is accelerated.

In FIG. 3 is shown a graph illustrating mutual diffused distribution of aluminum and zinc in the cross section of a composite plated layer obtained after rolling and heat treatment obtained by a scanning line analysis with the aid of an X-ray microanalyzer, the heat treatment being effected at a temperature of 550° C for 2 minutes after the rolling as described with reference to FIG. 2.

In FIG. 4 as shown a preferable range of temperature and time for heat treatments as is required for obtaining a good appearance of a plated sheet by a shaded area. As seen from FIG. 4, the heat treating temperature must not be higher than the shaded area and the heat treating time must also not be longer than the shaded area. If the heat treatment is carried out at a temperature for a time which is out of the shaded area shown in FIG. 4, a vigorous sublimation of zinc occurs to make the surface of the plated steel sheet rough and hence the appearance is spoiled. In practice, the heating time should be at most 30 minutes as shown in FIG. 4. It is preferable to heat a steel plate by passing current therethrough in atmospheric air for several seconds and then to cool the heated steel plate by air or water.

In the shaded area shown in FIG. 4, the alloy layer interposed between the iron substrate and the composite plated layer is no longer grown. As a result, there is no risk of the deep drawing workability being impaired. In addition, characteristics of the steel sheet are not deteriorated due to its thermal hysteresis.

The invention will now be described in greater detail with reference to the following example.

| | |
|---|---|
| Plating bath composition: | |
| $ZnSO4$ | 1 mol |
| $Na_2SO4$ | 0.2 mol |
| $Al_2(SO_4)3$ | 0.1 mol |
| Aluminum powder (at least 325 meshes, at most 44 μm diameter) | 70 g/l |
| Electrolysis condition: | |
| P.H. | 3.0 |
| Bath temperature | 60° C |
| Current density | 15 A/dm$^2$ |

A plating bath of the above mentioned composition was circulated in an electroplating tank by means of a pump. In the electroplating tank was rotatably arranged a cylindrical electrode having a diameter of 100 mm and immersed into the plating bath. A steel sheet having a width of 100 mm was wound around the cylindrical electrode which was rotated at a speed of 500 r.p.m. The electrolysis was carried out for 1 minute to obtain a composite plated layer having a thickness of about 9 μ. Content of aluminum in this plated layer was 29% by weight.

The composite plated steel sheet was removed from the cylindrical electrode. A test piece formed of this plated steel sheet was then subjected to a slight rolling step with a reduction rate of thickness of 2%. Another test piece was further subjected to heat treatment in a reducing atmosphere at 55° C for 2 minutes.

Use was made of another plating bath whose composition is the same as that of the above mentioned plating bath except the amount of the aluminum powder is increased to 120 g/l and hence the content of aluminum in the plated layer reaches to 48% by weight. The above mentioned steel sheet was coated with the composite plated layer in the same manner as that described above. A further test piece formed of this plated steel sheet thus obtained was subjected to the slight rolling with the reduction rate of thickness of 2% only. Thus, three kinds of test pieces were prepared whose characteristics were compared with those of a conventional molten zinc plated steel sheet and those of a conventional zinc electroplated steel sheet. The result yielded from such comparison test is shown in the following Table.

Table

| | | Various Characteristics of Plated Steel Sheet | | | | | | | | | | | | | | | |
|---|---|---|---|---|---|---|---|---|---|---|---|---|---|---|---|---|---|
| | | | | | | | | Workability | | | | | Corrosion resistance (salt spray test) | | | | Painting property (Grid-shaped cuts test) |
| | | | | | | | | Adhesion of plated layer (bending test) | | | | Deep drawing property | Not painted sheet | Directly painted sheet | | | |
| | Plated steel sheet | Electrical quantity in plating ($A/dm^2 \times min$) | Amount of plated layer ($g/m^2$) | Al content in plated layer (wt. %) | Appearance of plated layer (Spangle) | Phosphate treating property ($g/m^2$) | Weldability | 2T | 1T | 0.5T | 0T | (Limiting drawing ratio) | Duration until red rust occurs (days) | Width of blister of cross cuts (mm) 3 days | 5 days | 8 days | After peeling off tape (number of painted portion remained/100) |
| Comparison test piece | Molten Zn plated steel sheet | — | 200 | 0 | Present | 2.8 | Slightly good | ⊙ | ○ | △ | △ | — | 5 | 1 | 3 | 5 | 85/100 |
| | Zn electroplated steel sheet | $15A/dm^2 \times 1min$ | 30 | 0 | Absent | 3.3 | Good | ⊙ | ⊙ | ⊙ | ⊙ | 2.1 | 1 | 1 | 3 | 4 | 93/100 |
| | Composite Zn—Al dispersion plated steel sheet (2% rolling, no heat treatment) | $15A/dm^2 \times 1min$ | 42 | 29 | Absent | 3.6 | Good | ⊙ | ⊙ | ○ | ○ | 2.3 | 13 | 0 | 0 | 0 | 100/100 |
| Test piece according to the invention | Composite Zn—Al dispersion plated steel sheet (2% rolling, 550° C×2min) | $15A/dm^2 \times 1min$ | 42 | 29 | Absent | 3.3 | Good | ⊙ | ⊙ | ⊙ | ⊙ | 2.3 | 13 | 0 | 0 | 0 | 100/100 |
| | Composite Zn—Al dispersion plated steel sheet (2% rolling, no heat treatment) | $15A/dm^2 \times 1min$ | 59 | 48 | Absent | 3.0 | Good | ⊙ | ⊙ | ○ | ○ | — | 22 | 0 | 0 | 0 | 100/100 |

In the above table, the phosphate treating property of the plated steel sheet was measured by immersing the plated steel sheet into a conventional zinc phosphate treating bath at 65° C for 20 seconds.

The phosphate treating property is defined by 2 to 5 $g/m^2$ which is weight of the plated layer per unit area of that phosphate crystal which ensures the optimum anchorage effect of the plated layer.

The weldability of the plated steel sheet was measured by a lap resistance welding with a nugget of 5 mm by passing a welding current of 10 KA under a pressure of 150 Kg for 10 cycles.

The adhesion of the plated layer was measured by a bending test defined by JIS Z2248. That is, a plated steel sheet having a thickness of T was bent into U-shaped legs with its inside radius of the bent portion of 2T, 1T, 0.5T and OT, respectively. The inside radius of the bent portion OT shall be understood to mean that both the U-shaped legs closely make contact with each other. In the above table, the thickness T of the molten zinc plated steel sheet is 0.54 mm, while the thickness T of the other plated steel sheets are 0.33 mm, respectively. A symbol O means that the plated layer shows no cracks at its bent portion, ○ means that the plated layer shows extremely little cracks at its bent portion, and Δ means that the plated layer shows a little cracks at its bent portion.

The deep drawing property was measured by using a punch having a diameter of 33 mm and a supporting weight of 500 Kg and a lubricant.

The corrosion resistance was measured by a salt spray test defined by JIS Z2371. The painting was effected by a conventional electrodeposition paint and the baking condition at 170° C for 25 minutes to obtain a paint coating having a thickness of 30 μ.

As seen from the above table, the composite plated layer according to the invention does not produce any spangle, can be directly painted without spoiling the painting property of paint, has phosphate treating property which is substantially comparable with that of the comparison test pieces and hence is suitable to be treated by a conventional phosphate process, has weldability comparable with that of the comparison test piece, and has an adhesion which is slightly inferior to that of the conventional zinc electroplated layer, but becomes equal thereto when subjected to the heat treatment.

As stated hereinbefore, the invention can be applied to a steel sheet to be painted and particularly to a colored zinc plated iron sheet and to a surface treated steel sheet for automobiles which is subjected to severe working after plating so as to significantly improve quality of these iron or steel sheets. In addition, the composite zinc-aluminum dispersion plated steel sheet according to the invention is not required to be exposed to thermal hysteresis which has been encountered with the conventional molten zinc-aluminum alloy plated steel sheet, so that there is no risk of the quality of the plated steel sheet being deteriorated by such thermal hysteresis. The composite zinc-aluminum dispersion plated steel sheet according to the invention produces no spangle and hence does not interfere with any subsequent painting of the plated steel sheet.

The method according to the invention has a number of advantages. In the first place, a composite zinc-aluminum dispersion plated steel sheet can easily be produced. Secondly, in the same one plating tank the aluminum content in the composite zinc-aluminum dispersion plated layer can freely be controlled by the amount of aluminum to be added to the plating bath, by the moving speed of the steel plate to be plated and by the temperature of the plating bath. Third, the thickness of the plated coating can precisely be controlled by the electrical quantity. Fourth, aluminum is bonded to zinc as it is deposited, so that the apparent current efficiency far exceeds 100% and hence the electrical energy can be economized. Fifth, the electrolysis is carried out at a temperature which is considerably lower than the molten zinc plating temperature, so that severe themal hysteresis is not subjected to the steel sheet to be plated. Sixth, even when the heat treatment is effected as the final step, aluminum makes contact with zinc over an extremely large area in the composite zinc-aluminum dispersion plated layer, so that the alloying is easily advanced without requiring a heat treatment at a high temperature for a long time. Seventh, an alloy layer formed of iron and zinc-aluminum is not produced at an interphase between the iron substrate and the plated layer, so that the plated layer is excellent in its adhesion and workability. Finally, the plating bath has no source for supplying impurities such as iron, tin, lead and the like, so that it is possible to obtain a composite zinc-aluminum dispersion plated layer which is pure and enhance corrosion resistance thereof.

What is claimed is:

1. A composite comprising a steel sheet substrate having electrolytically plated thereon a layer consisting essentially of 1.5–70% by weight of aluminum dispersed in zinc, said layer having been plated electrolytically from an electrolytical zinc plating bath containing dispersed aluminum powder of a particle size of at least 100 meshes (at most 147 μm diameter) while agitating said bath, said composite being characterized by the substantial absence of a detrimental alloy layer of iron and of zinc-aluminum at the interface of said substrate and said layer.

2. The composite of claim 1, wherein said aluminum powder in said bath has a particle size of at least 325 meshes (at most 44 μm diameter).

3. The composite of claim 1, wherein the amount of said aluminum powder in said bath is 5 to 300 g/l.

4. The composite of claim 1, wherein the amount of said aluminum powder in said bath is 20 to 100 g/l.

5. The composite of claim 1, having been subjected to a subsequent rolling step.

6. The composite of claim 5 having been subjected to a subsequent heat treating step.

7. The composite of claim 5, wherein said rolling step is effected with a reduction rate of thickness of at most 5%.

8. The composite of claim 6, wherein said heating step is effected at a temperature for a time defined by the shaded area shown in FIG 4.

* * * * *